US008840048B2

(12) United States Patent
Agresta et al.

(10) Patent No.: US 8,840,048 B2
(45) Date of Patent: Sep. 23, 2014

(54) INJECTION VALVE

(75) Inventors: Antonio Agresta, Pisa (IT); Gianbattista Fischetti, Cascina (IT); Luigi Gargiulo, Pisa (IT); Marco Mechi, Vada (IT)

(73) Assignee: Continental Automotive GmbH, Hannover (DE)

( * ) Notice: Subject to any disclaimer, the term of this patent is extended or adjusted under 35 U.S.C. 154(b) by 471 days.

(21) Appl. No.: 13/260,479

(22) PCT Filed: Mar. 23, 2010

(86) PCT No.: PCT/EP2010/053782

§ 371 (c)(1),
(2), (4) Date: Nov. 15, 2011

(87) PCT Pub. No.: WO2010/108922

PCT Pub. Date: Sep. 30, 2010

(65) Prior Publication Data

US 2012/0043392 A1 Feb. 23, 2012

(30) Foreign Application Priority Data

Mar. 25, 2009 (EP) ..... 09004291

(51) Int. Cl.

| | |
|---|---|
| ***B05B 1/30*** | (2006.01) |
| ***F02M 61/20*** | (2006.01) |
| ***F02M 51/06*** | (2006.01) |

(52) U.S. Cl.

CPC ..... *F02M 61/20* (2013.01); *F02M 61/205* (2013.01); *F02M 51/0685* (2013.01); *F02M 2200/306* (2013.01); *F02M 2200/304* (2013.01); *F02M 2200/28* (2013.01); *F02M 51/066* (2013.01)

USPC ..... 239/585.5; 239/533.9

(58) Field of Classification Search

CPC ..... B05B 1/30; B05B 11/02; B05B 1/3046

USPC ..... 239/585.5, 585.1, 585.3, 585.4, 584, 239/533.12, 533.9, 533.11

See application file for complete search history.

(56) References Cited

U.S. PATENT DOCUMENTS

| | | | | |
|---|---|---|---|---|
| 5,544,816 | A * | 8/1996 | Nally et al. | 239/585.5 |
| 6,523,759 | B1 | 2/2003 | D'Arrigo | 239/585.1 |

(Continued)

FOREIGN PATENT DOCUMENTS

| | | | | |
|---|---|---|---|---|
| CN | 1776214 | A | 5/2006 | F02M 51/06 |
| DE | 102005023368 | A1 | 11/2006 | F02M 45/08 |

(Continued)

OTHER PUBLICATIONS

Japanese Office Action, Application No. 2012-501285, 9 pages, Jan. 25, 2013.

(Continued)

*Primary Examiner* — Davis Hwu

(74) *Attorney, Agent, or Firm* — King & Spalding L.L.P.

(57) ABSTRACT

An injection valve for injecting fluid has a housing with an injection valve cavity. The injection valve has a needle being axially moveable within the cavity. The needle has a needle body with a valve needle cavity and a separation element being fixedly arranged within the needle cavity and being adopted to divide the valve needle cavity into a first and second fluid volume. The separation element has at least one fluid passage with a predetermined passage opening to hydraulically connect the first fluid volume with the second fluid volume. The valve needle has a sealing element being arranged to predetermine the first fluid volume and preventing a fluid injection in a closing position and permitting the fluid injection in further positions. In addition, the valve needle has at least one spring element being preloaded and acting on the sealing element towards a maximum axial expansion of the valve needle.

18 Claims, 1 Drawing Sheet

(56) References Cited

U.S. PATENT DOCUMENTS

| | | | | |
|---|---|---|---|---|
| 7,422,165 | B2 | 9/2008 | Cernoia et al. | 239/585.1 |
| 2011/0041807 | A1 | 2/2011 | Cooke | 123/445 |

FOREIGN PATENT DOCUMENTS

| | | | | |
|---|---|---|---|---|
| DE | 102005037581 | A | 2/2007 | F02M 51/06 |
| EP | 0890736 | A2 | 1/1999 | F02M 61/20 |
| EP | 1063419 | A2 | 12/2000 | F02M 51/06 |
| EP | 1063419 | A3 | 7/2003 | F02M 51/06 |
| JP | 2007255418 | A | 10/2007 | F02M 51/06 |
| WO | 2010/108922 | A1 | 9/2010 | F02M 61/20 |

OTHER PUBLICATIONS

Chinese Office Action, Application No. 201080013361.X, 15 pages, Dec. 4, 2012.

International PCT Search Report, PCT/EP2010/053782, 10 pages, Mailed Jul. 5, 2010.

* cited by examiner

INJECTION VALVE

CROSS-REFERENCE TO RELATED APPLICATIONS

This application is a U.S. National Stage Application of International Application No. PCT/EP2010/053782 filed Mar. 23, 2010, which designates the United States of America, and claims priority to EP Application No. 09004291.2 filed Mar. 25, 2009, the contents of which are hereby incorporated by reference in their entirety.

TECHNICAL FIELD

The invention relates to an injection valve for injecting fluid.

BACKGROUND

Injection valves are in widespread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a valve needle of the injection valve, which may, for example, be an electromagnetic actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of up to 2000 bar.

U.S. Pat. No. 6,523,759 B1 discloses that during operation of the injection valve, a close action of the valve needle to prevent dosing of fluid into the intake manifold or into the combustion chamber is followed by an unwanted reopen and close phase of the valve needle, called needle bounce. During the unwanted reopen and close phase, unwanted fluid is dispensed from the injection valve, resulting in a degraded performance of the injection valve. Therefore, a flow restrictor is disposed in an armature of the valve needle to restrict fluid flow towards an upstream end of the armature, resulting in a reduced bouncing of the valve needle.

SUMMARY

According to various embodiments, an injection valve can be created which facilitates a reliable and precise function.

According to an embodiment, an injection valve for injecting fluid, may comprise:—a longitudinal axis,—an injection valve housing with an injection valve cavity,—a valve needle being axially moveable within the injection valve cavity and comprising:—a valve needle body comprising a valve needle cavity,—a separation element being fixedly arranged within the valve needle cavity and being adopted to divide the valve needle cavity into a first and second fluid volume and comprising at least one fluid passage with a predetermined passage opening to hydraulically connect the first fluid volume with the second fluid volume, a sealing element being axially moveable and being arranged to predetermine the first fluid volume and preventing a fluid injection in a closing position and permitting the fluid injection in further positions, and at least one spring element being preloaded and acting on the sealing element towards a maximum axial expansion of the valve needle.

According to a further embodiment, the sealing element may have a spherical or conical shape. According to a further embodiment, the at least one fluid passage can be an axial boring. According to a further embodiment, the sealing element and/or the valve needle body can be adopted to basically prevent a fluid flowing between the sealing element and an inner wall of the valve needle cavity. According to a further embodiment, the sealing element and/or the valve needle body can be adopted to provide a predetermined leakage characteristic, while the sealing element moves in axial directions. According to a further embodiment, the valve needle body may comprise a projection where the sealing element rests on, if the valve needle reaches its maximum axial expansion. According to a further embodiment, a first seat of the at least one spring element can be formed by the separation element. According to a further embodiment, a second seat of the at least one spring element can be formed by the sealing element. According to a further embodiment, the at least one spring element can be a helical spring and is arranged within the first fluid volume.

BRIEF DESCRIPTION OF THE DRAWINGS

Exemplary embodiments are explained in the following with the aid of schematic drawings. These are as follows.

Figure 1:
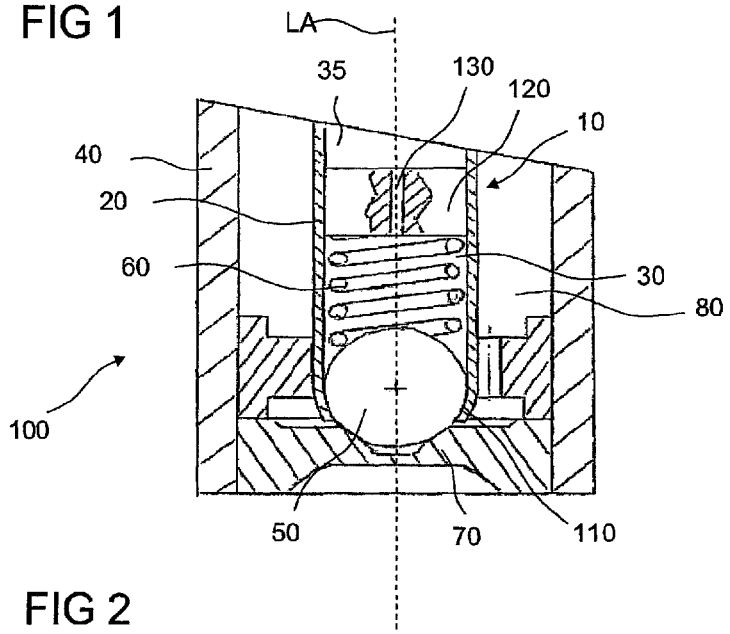
FIG. 1 injection valve with a valve needle and a valve needle seat.

Elements of the same design or function that appear in different illustrations are identified by the same reference sign.

DETAILED DESCRIPTION

According to various embodiments, an injection valve for injecting fluid may comprise a longitudinal axis and injection valve housing with an injection valve cavity. The injection valve further comprises a valve needle being axially moveable within the injection valve cavity. The valve needle comprises a valve needle body with a valve needle cavity. Furthermore, the valve needle comprises a separation element being fixedly arranged within the valve needle cavity and being adopted to divide the valve needle cavity into a first and second fluid volume. The separation element comprises at least one fluid passage with a predetermined passage opening to hydraulically connect the first fluid volume with the second fluid volume. The valve needle further comprises a sealing element being axially moveable and being arranged to predetermine the first fluid volume. The sealing element is adopted to prevent a fluid injection in a closing position and to permit the fluid injection in further positions. The valve needle comprises at least one spring element being preloaded and acting on the sealing element towards a maximum axial expansion of the valve needle. This contributes to minimizing a bouncing of the valve needle and by this contributes to ensuring a reliable and precise fluid injection. Preferably the valve needle body is coupled to an armature which is operable to be actuated by a solenoid in case of an electromagnetic actuated injection valve. In case of a piezoelectric injection valve, the valve needle body is preferably coupled to a piezoelectric actuator. The valve needle body and the sealing element are axially moveable relative to each other.

The first and second fluid volume are designed to be filled with fluid. While the first fluid volume decreases, e.g. due to an axial movement of the sealing element towards the separation element, the fluid within the first fluid volume is forced to pass the fluid passage with its predetermined passage opening, by this dampening the axial movement of the sealing element and/or the valve needle body. By varying the dimension of the passage opening of the fluid passage and/or by varying the amount of fluid passages, the dampening can be varied.

The first fluid volume is predetermined by the arrangement of the separation element within the valve needle cavity and the current axial position of the sealing element. If the valve needle is expanded to a maximum axial expansion, the first fluid volume is maximized. If the axial expansion of the valve needle is decreased, e.g. due to an axial movement of the sealing element and/or the valve needle body, the first fluid volume is decreased, forcing the fluid to pass through the at least one fluid passage into the second fluid volume.

In an embodiment, the sealing element has a spherical or conical shape. This contributes to ensuring a reliable and precise function of the injection valve.

In a further embodiment, the at least one fluid passage is an axial boring. By this, a manufacturing of the injection valve can be simplified.

In a further embodiment, the sealing element and/or the valve needle body is adopted to basically prevent a fluid flowing between the sealing element and the wall of the first fluid volume. By this, the fluid within the valve needle cavity basically flows through the at least one fluid passage of the separation element. By this, the dampening of the axial movement of the sealing element and/or the valve needle body can be easily varied by only varying the dimension of the passage opening of the at least one fluid passage and/or by varying the amount of fluid passages of the separation element while manufacturing the injection valve.

In a further embodiment, the sealing element and/or the valve needle body is adopted to provide a predetermined leakage characteristic, while the sealing element moves in axial direction. Via the leakage characteristic the first fluid volume is hydraulically connected with the injection valve cavity. The predetermined leakage can for example be realized by designing the sealing element and/or the valve needle body in such a way, that a predetermined radial clearance is provided between the sealing element and an inner wall of the valve needle cavity, preferably while the sealing element moves axially.

Alternatively the sealing element and/or the valve needle body can be adopted to basically prevent a fluid flowing while the valve needle is expanded to the maximum axial expansion, e.g. while the sealing element is in further positions, and to provide the predetermined leakage characteristic while the valve needle has a decreased axial expansion, e.g. while the sealing element is in its closing position.

In a further embodiment, the valve needle body comprises a projection where the sealing element rests on, if the valve needle reaches its maximum axial expansion. The maximum axial expansion is for example reached if the sealing element is in further positions. The projection is preferably formed by plastical deformation of the valve needle body. Using the projection to limit the axial expansion of the valve needle contributes to simplifying the manufacturing of the injection valve. Preferably the projection is formed in such a way, that a fluid flow is basically prevented, if the sealing element rests on the projection.

In a further embodiment, a first seat of the at least one spring element is formed by the separation element. This contributes to ensuring a simple and cost efficient manufacturing of the injection valve.

In a further embodiment, a second seat of the at least one spring element is formed by the sealing element. This contributes to ensuring a simple and cost efficient manufacturing of the injection valve.

In a further embodiment, the at least one spring element is a helical spring and being arranged within the first fluid volume. This contributes to ensuring a robust injection valve.

An injection valve 100 (FIG. 1) that is in particular suitable for dosing fluid into an internal combustion engine, comprises an injection valve housing 40 with a central longitudinal axis LA, an injection valve cavity 80, a valve needle 10 and a valve needle seat 70. The valve needle 10 comprises a valve needle body 20, a separation element 120, a sealing element 50 and a spring element 60.

The valve needle body 20 preferably has a cylindrical shape and is actuated by an actuator of the injection valve 100, e.g. an electromagnetic actuator or a piezoelectric actuator. While being actuated, the valve needle body 20 moves axially within the injection valve cavity 80. The valve needle body 20 comprises a valve needle cavity, wherein the separation element 120 is fixedly arranged, dividing the valve needle cavity into a first and second fluid volume 30, 35. The injection valve cavity 80, the first and second fluid volume 30, 35 are designed to by filled with fluid, e.g. fuel.

The sealing element 50 is at least partially disposed within the valve needle cavity to limit the first fluid volume 30 and has a spherical shape. Alternatively, the sealing element 50 has a conical shape. In a closing position of the valve needle 10, the sealing element 50 sealingly rests on the valve needle seat 70, by this preventing a fluid flow through at least one injection nozzle of the injection valve 100. The injection nozzle may be, for example, an injection hole. However, it may also be of some other type suitable for dosing fluid. The sealing element 50 permits the fluid injection into the combustion chamber in further positions, i.e. when it does not rest on the valve needle seat 70. The further positions represent non-closing positions.

The sealing element 50 and the valve needle body 20 are relatively moveable to each other in axial direction. The valve needle body 20 comprises a projection 110, which forms a seat where the sealing element 50 preferably rests on, if the sealing element 50 is in a non-closing position. E.g. the projection 110 may be formed by means of plastical deformation. The non-closing position of the sealing element 50 represents a maximum axial expansion of the valve needle 10. The axial expansion of the valve needle is preferably decreased if the sealing element 50 rests on the valve needle seat 70 in the closing position.

The spring element 60 is a helical spring and preferably made of stainless steel. The spring element 60 is arranged within the first fluid volume 30. The separation element 120 forms a first seat of the spring element 60 and the sealing element 50 itself forms a second seat of the spring element 60. The spring element 60 is preloaded and acts on the sealing element 90 towards a maximum expansion of the valve needle 10 in axial direction. If the sealing element 50 rests on the projection 110 the axial expansion of the valve needle 10 is maximized.

The separation element 120 comprises an axial fluid passage 130 to hydraulically connect the first with the second fluid volume 30, 35. The fluid passage 130 is preferably an axial boring with a predetermined diameter, representing a predetermined passage opening. The fluid passage 130 is adopted to pass fluid from the first fluid volume 30 into the second fluid volume 35 and vice versa, due to the axial movement of the sealing element 50 relative to the valve needle body 20.

If the sealing element 50 impacts the valve needle seat 70 in a closing phase of the injection valve 100, the spring element 60 basically decouples the sealing element 50 from the axial movement of the valve needle body 20. After the sealing element 50 impacts the valve needle seat 70, the valve needle body 20 typically oscillates in axial direction with decreasing oscillation amplitudes. The axial movements of the valve needle body 20 basically do not affect the position of the sealing element 50 which rests on the valve needle seat 70, while the kinetic energy of the valve needle body 20 is at least partially absorbed by the spring element 60. In a compression phase, i.e. in a phase where the volume of first fluid volume 30 decreases due to the movement of the valve needle body 20, the fluid within the first fluid volume 30 is forced to pass through the fluid passage 130 into the second fluid volume 90. A damping constant of the decreasing oscillation of the valve needle body 20 is dependent on the spring rate of the spring element 60 and on the predetermined diameter of the passage 130. Due to the decoupling of the axial oscillation of the valve needle body 20 and the sealing element 50, the sealing element 50 basically rests on the valve needle seat 70. This reduces a bouncing of the sealing element 50 after impacting the valve needle seat 70 in the closing phase and reduces an uncontrolled fluid injection during the closing phase of the injection valve 100.

The sealing element 50 and/or the valve needle body 20 are adopted to basically prevent a fluid flow between the sealing element 50 and an inner wall of the first fluid volume 30. By this, the fluid is basically passed through the fluid passage 130, if the sealing element 50 moves axially.

Figure 2:
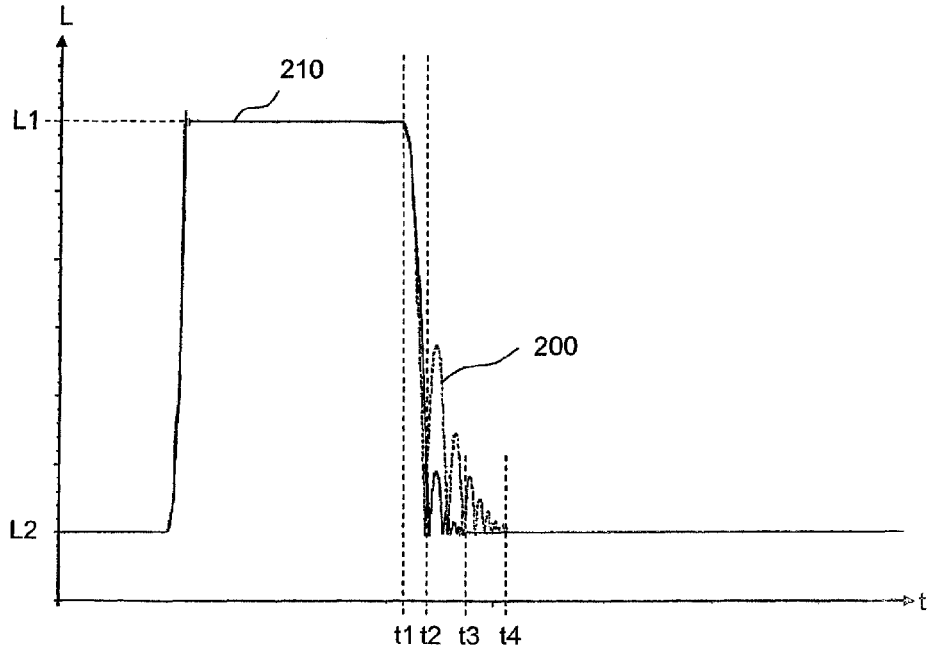
FIG. 2 diagram.

FIG. 2 depicts a time diagram illustrating a bounce of the sealing element 50. A first characteristic 200 represents a lift L of the sealing element 50 in an injection valve without reduced bouncing. A second characteristic 210 represents the lift L of the sealing element 50 in the injection valve 100 according to FIG. 1, i.e. with reduced bouncing. A first lift L1 represents a non-closing position of the particular sealing element 50. A second lift L2 represents the closing position of the particular sealing element 50. In a first point in time t1 the particular injection valve 100 enters its closing phase. The particular sealing element impacts the valve needle seat 70 in a second point in time t2 to stop the fluid injection.

As shown in FIG. 2, the injection valve without reduced bouncing of the sealing element has multiple unwanted reopen phases in which fluid is dispensed from the injection valve. The fluid injection finally stops at a fourth point in time t4, in which the kinetic energy of the valve needle is dissipated.

As depicted in FIG. 2, the injection valve 100 according to FIG. 1 has also multiple unwanted reopen phases, represented by the second characteristic 210. Compared to the first characteristic 200 the amount of reopen phases is significantly reduced. Furthermore, the particular amplitudes representing the particular lifts of the particular sealing element of the second characteristic 210 are significantly reduced compared to the particular amplitudes of the first characteristic 200. The fluid injection finally stops at a third point in time t3, which is before the forth point in time t4.

In another embodiment, the sealing element 50 and/or the valve needle body 50 is adopted to provide a predetermined radial clearance between the sealing element 50 and the inner wall of the valve needle cavity, preferably if the sealing element does not rest on the projection 110. The radial clearance forms a hydraulical connection between the first fluid volume 30 and the injection valve cavity 80. By predetermining the opening of the radial clearance between the sealing element 50 and the inner wall of the valve needle cavity, the dampening of the oscillation of the valve needle body 20 can be varied thus reducing the bouncing of the sealing element 50. The radial predetermined clearance represents a predetermined leakage characteristic.

In a further embodiment, the separation element 120 comprises more than one fluid passage 130 with each comprising one or more predetermined openings.

In a further embodiment, the valve needle 10 comprises more than one spring element 60.

What is claimed is:

1. An injection valve for injecting fluid, comprising:
- a longitudinal axis,
- an injection valve housing with an injection valve cavity,
- a valve needle axially moveable within the injection valve cavity and comprising:
  - a valve needle body defining a valve needle cavity in the valve needle body,
  - a separation element fixedly arranged within the valve needle cavity in the valve needle body, the separation element dividing the valve needle cavity into a first fluid volume and a second fluid volume and comprising at least one fluid passage with a predetermined passage opening to hydraulically connect the first fluid volume with the second fluid volume,
  - a sealing element axially moveable between a closing position in which a fluid injection is prevented by the sealing element and further positions in which a fluid injection is allowed, the location of the moveable sealing element defining the first fluid volume,
  - wherein the valve needle body is axially movable relative to the sealing element in the closing position of the sealing element, and
  - at least one preloaded spring element acting on the sealing element towards a maximum axial expansion of the valve needle.

2. The injection valve according to claim 1, wherein the sealing element has a spherical or conical shape.

3. The injection valve according to claim 1, wherein the at least one fluid passage is an axial boring.

4. The injection valve according to claim 1, wherein at least one of the sealing element and the valve needle body is configured to substantially prevent a fluid flowing between the sealing element and an inner wall of the valve needle cavity.

5. The injection valve according to claim 1, wherein the sealing element and/or the valve needle body is configured to provide a predetermined leakage characteristic, while the sealing element moves in axial directions.

6. The injection valve according to claim 1, wherein the valve needle body comprises a projection upon which the sealing element rests when the valve needle reaches its maximum axial expansion.

7. The injection valve according to claim 1, wherein a first seat of the at least one spring element is formed by the separation element.

8. The injection valve according to claim 1, wherein a second seat of the at least one spring element is formed by the sealing element.

9. The injection valve according to claim 1, wherein the at least one spring element is a helical spring and is arranged within the first fluid volume.

10. A method for operating an injection valve for injecting fluid, the injection valve having a longitudinal axis, an injection valve housing with an injection valve cavity, a valve needle axially moveable within the injection valve cavity and comprising a valve needle body defining a valve needle cavity in the valve needle body, and a separation element fixedly arranged within the valve needle cavity in the valve body, the method comprising:

dividing the valve needle cavity within the valve needle body into a first fluid volume and a second fluid volume on opposite sides of the separation element and hydraulically connecting the first fluid volume with the second fluid volume by at least one fluid passage with a predetermined passage opening extending through the separation element, predetermining the first fluid volume by a sealing element that is axially moveable between a closing position in which a fluid injection is prevented by the sealing element and further positions in which the fluid injection is allowed, allowing axial movement of the valve needle body relative to the sealing element in the closing position of the sealing element, and preloading at least one spring element to act on the sealing element towards a maximum axial expansion of the valve needle.

11. The method according to claim 10, wherein the sealing element has a spherical or conical shape.

12. The method according to claim 10, wherein the at least one fluid passage is an axial boring.

13. The method according to claim 10, wherein at least one of the sealing element and the valve needle body is configured to substantially prevent a fluid flowing between the sealing element and an inner wall of the valve needle cavity.

14. The method according to claim 10, wherein the sealing element and/or the valve needle body is configured to provide a predetermined leakage characteristic, while the sealing element moves in axial directions.

15. The method according to claim 10, wherein the valve needle body comprises a projection upon which the sealing element rests when the valve needle reaches its maximum axial expansion.

16. The method according to claim 10, wherein a first seat of the at least one spring element is formed by the separation element.

17. The method according to claim 10, wherein a second seat of the at least one spring element is formed by the sealing element.

18. The method according to claim 10, wherein the at least one spring element is a helical spring and is arranged within the first fluid volume.

* * * * *